US009359848B2

(12) United States Patent
Surjaatmadja et al.

(10) Patent No.: US 9,359,848 B2
(45) **Date of Patent: *Jun. 7, 2016**

(54) SYSTEMS AND METHODS FOR REMOVING A SECTION OF CASING

(71) Applicant: Halliburton Energy Services, Inc., Houston, TX (US)

(72) Inventors: Jim Basuki Surjaatmadja, Duncan, OK (US); Jorn Tore Giskemo, Tananger (NO); Oyvind Rakstang, Tananger (NO); Aimee Greening, Duncan, OK (US); Desmond Jones, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 388 days.

This patent is subject to a terminal disclaimer.

(21) Appl. No.: 13/909,190

(22) Filed: Jun. 4, 2013

(65) Prior Publication Data

US 2014/0352964 A1 Dec. 4, 2014

(51) Int. Cl.
*E21B 29/06* (2006.01)
*E21B 29/00* (2006.01)

(52) U.S. Cl.
CPC ..... *E21B 29/002* (2013.01); *E21B 29/06* (2013.01)

(58) Field of Classification Search
CPC ..... E21B 29/06; E21B 29/002
USPC ..... 166/298
See application file for complete search history.

(56) References Cited

U.S. PATENT DOCUMENTS 3,052,298 A * 9/1962 Malott ..... E21B 33/14 166/222
3,081,828 A * 3/1963 Quick ..... E21B 29/00 166/55

(Continued)

FOREIGN PATENT DOCUMENTS

WO 2009071962 A2 6/2009
WO 2011151271 A1 12/2011
WO 2014197314 A1 12/2014

OTHER PUBLICATIONS

International Search Report and Written Opinion for PCT/US2014/040241 filed Oct. 1, 2014.

*Primary Examiner* — Jennifer H Gay
*Assistant Examiner* — George Gray
(74) *Attorney, Agent, or Firm* — McDermott Will & Emery LLP; Alan Bryson

(57) ABSTRACT

A method includes conveying a casing cutting tool into the wellbore lined with at least one casing string and cement, and stroking the casing cutting tool over a predetermined axial length of the wellbore while ejecting fluid from one or more nozzles in the casing cutting tool and thereby forming a plurality of longitudinal cuts through the casing string and cement. The casing cutting tool is then rotated about its longitudinal axis at two or more axially offset locations along the predetermined axial length while ejecting fluid from nozzles and thereby forming a plurality of axially offset transverse cuts in the casing string and the cement. The longitudinal cuts and axially offset transverse cuts form wedges in the wellbore, and the wedges are dislodged from the wellbore to expose formation rock along the predetermined axial length.

18 Claims, 4 Drawing Sheets

(56) References Cited

U.S. PATENT DOCUMENTS 3,391,737 A * 7/1968 Havens ..... E21B 33/14 166/222
4,119,151 A 10/1978 Smith
4,346,761 A * 8/1982 Skinner ..... E21B 23/006 166/206
6,595,289 B2 7/2003 Tumlin et al.
6,932,158 B2 8/2005 Burts, III
8,245,797 B2 8/2012 Jurica et al.
2005/0263282 A1 12/2005 Jeffrey et al.
2007/0251692 A1 * 11/2007 Billingham ..... E21B 44/005 166/297
2011/0209540 A1 9/2011 Banks et al.
2012/0074110 A1 3/2012 Zediker et al.
2012/0298372 A1 11/2012 Bamford
2013/0199785 A1 * 8/2013 Hekelaar ..... E21B 29/005 166/298
2014/0231087 A1 * 8/2014 Orstad ..... E21B 31/16 166/298

* cited by examiner

SYSTEMS AND METHODS FOR REMOVING A SECTION OF CASING

BACKGROUND

The present disclosure relates to systems and methods of plugging a wellbore for abandonment and, more particularly, using a casing cutting tool having fluid jet nozzles for removing wellbore casing in preparation for the placement of a cement plug.

In the oil and gas industry, once a hydrocarbon bearing well reaches the end of its useful life, the well is decommissioned for abandonment. Regulations under various state and federal laws require decommissioned wells to be properly plugged and sealed using various "plug and abandonment" procedures before abandoning the well. Plug and abandonment operations performed in a cased wellbore require that certain portions of the wellbore be filled with cement to prevent the upward movement of fluids towards the surface of the well. To seal the wellbore, a bridge plug is typically placed at a predetermined depth within the wellbore and cement is then introduced to form a column of cement high enough to ensure that the wellbore is permanently plugged.

In addition to simply sealing the interior of the wellbore, state and federal regulations also often require that an area outside of the wellbore be sufficiently blocked to prevent any fluids from migrating towards the surface of the well along the outside of the casing string. For example, in well completions having multiple strings of casing lining the wellbore, the annular area between the concentric strings can form a fluid path in spite of being cemented into place when the well was initially completed. The combination of bad cement jobs and weakening conditions of cement over time can lead to paths being opened in the cement that may facilitate the passage of fluid to the surface.

In order to ensure the area outside of the wellbore is adequately blocked, cement is typically injected or "squeezed" through perforations in the casing and into the formation surrounding the wellbore. By pumping cement in a non-circulating system, a predetermined amount of cement may be forced into the surrounding formation and can thereafter cure to form a fluid barrier. In cases where the wellbore to be plugged and abandoned has an outer string of casing and an inner string of casing coaxially disposed therein, the annular space between the concentric strings must be squeezed with cement to prevent the subsequent migration of fluid towards the surface of the well.

The cement squeeze approach, however, does not guarantee that the cement fully contacts the surrounding formation since the cement is typically required to pass through a narrow passage which may or may not allow the cement to reach all areas at the rock phase. As a result, the plug job may be compromised and rendered at least partially ineffective. Another approach that exposes the surrounding rock formation is reaming out the wellbore over the desired area. Reaming, however, is quite time consuming and costly and therefore not a viable alternative in some wells.

SUMMARY OF THE DISCLOSURE

The present disclosure relates to systems and methods of plugging a wellbore for abandonment and, more particularly, using a casing cutting tool having fluid jet nozzles for removing wellbore casing in preparation for the placement of a cement plug.

In some aspects, a method of removing a section of a wellbore is disclosed. The method may include conveying a casing cutting tool into the wellbore on a conveyance, the wellbore being lined with at least one casing string and cement, and the casing cutting tool including a jetting tool having one or more nozzles arranged thereon, stroking the casing cutting tool with the conveyance over a predetermined axial length of the wellbore while ejecting fluid from the one or more nozzles and thereby forming a plurality of longitudinal cuts through the at least one casing string and cement, rotating the casing cutting tool about its longitudinal axis at two or more axially offset locations along the predetermined axial length while ejecting fluid from the one or more nozzles and thereby forming a plurality of axially offset transverse cuts in the at least one casing string and the cement, whereby the plurality of longitudinal cuts and the plurality of axially offset transverse cuts form one or more wedges in the wellbore, each wedge comprising a portion of the at least one casing string and cement, and dislodging the one or more wedges from the wellbore and thereby exposing formation rock along at least a portion of the predetermined axial length.

In other aspects, a system is disclosed that may include a wellbore formed through one or more subterranean formations and being lined with at least one casing string and cement, a casing cutting tool conveyed into the wellbore on a conveyance and including a jetting tool having one or more nozzles arranged thereon, the jetting tool being configured to form a plurality of longitudinal cuts and a plurality of transverse cuts in the at least one casing string and the cement across a predetermined axial length of the wellbore with fluid ejected from the one or more nozzles, wherein one or more wedges are defined in the wellbore as a result of the plurality of longitudinal and transverse cuts, and a rathole defined in the wellbore below the predetermined axial length of the wellbore and above a bridge plug arranged within the wellbore, the rathole being configured to receive the one or more wedges once dislodged from surrounding formation rock and thereby exposing the formation rock along at least a portion of the predetermined axial length.

In yet other aspects, a casing cutting test fixture is disclosed and may include a chamber body supported on a base with one or more legs, the chamber body being configured to receive therein a sample wellbore section including a sample casing string and cement, wherein a rathole is defined below the sample wellbore section within the chamber body, a casing cutting tool movably arranged within the chamber body and including a jetting tool having one or more nozzles arranged thereon, the jetting tool being configured to form a plurality of longitudinal cuts and a plurality of transverse cuts in the sample wellbore section with fluid ejected from the one or more nozzles, a swivel head operatively coupled to the casing cutting tool via a top mandrel that extends from the swivel head and into the chamber body, the swivel head being configured to rotate the casing cutting tool about a longitudinal axis such in order to form the plurality of transverse cuts, and one or more stroking devices operatively coupled to the casing cutting tool via at least one of the swivel head and the top mandrel, the one or more stroking devices being configured to raise and lower the casing cutting tool within the chamber body in order form the plurality of longitudinal cuts.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to systems and methods of plugging a wellbore for abandonment and, more particularly, using a casing cutting tool having fluid jet nozzles for removing wellbore casing in preparation for the placement of a cement plug.

Disclosed herein are systems and methods used to decommission wellbores in compliance with laws and regulations for abandonment purposes. According to the present disclosure, a casing cutting tool may be introduced into a wellbore and configured to excise a portion of the wellbore using a jetting tool having one or more nozzles arranged therein. The nozzles may be configured to eject a fluid, such as an abrasive cutting solution, configured to cut into and through one or more casing strings and accompanying cement bonds disposed in the wellbore. The casing cutting tool may make both longitudinal and radial cuts (and any combination thereof) into and through one or more casing strings and cement bonds such that slats, chunks, or wedges of the wellbore walls are removed, thereby exposing the rock face of the surrounding subterranean formation. By removing the casing and cement all the way to the rock face, a cement plug may then be placed at that location in direct contact with the formation rock and thereby permanently seal the wellbore for abandonment. As will be appreciated, such systems and methods may prove advantageous in replacing costly and time-consuming reaming processes currently used in wellbore abandonment operations.

Figure 1:
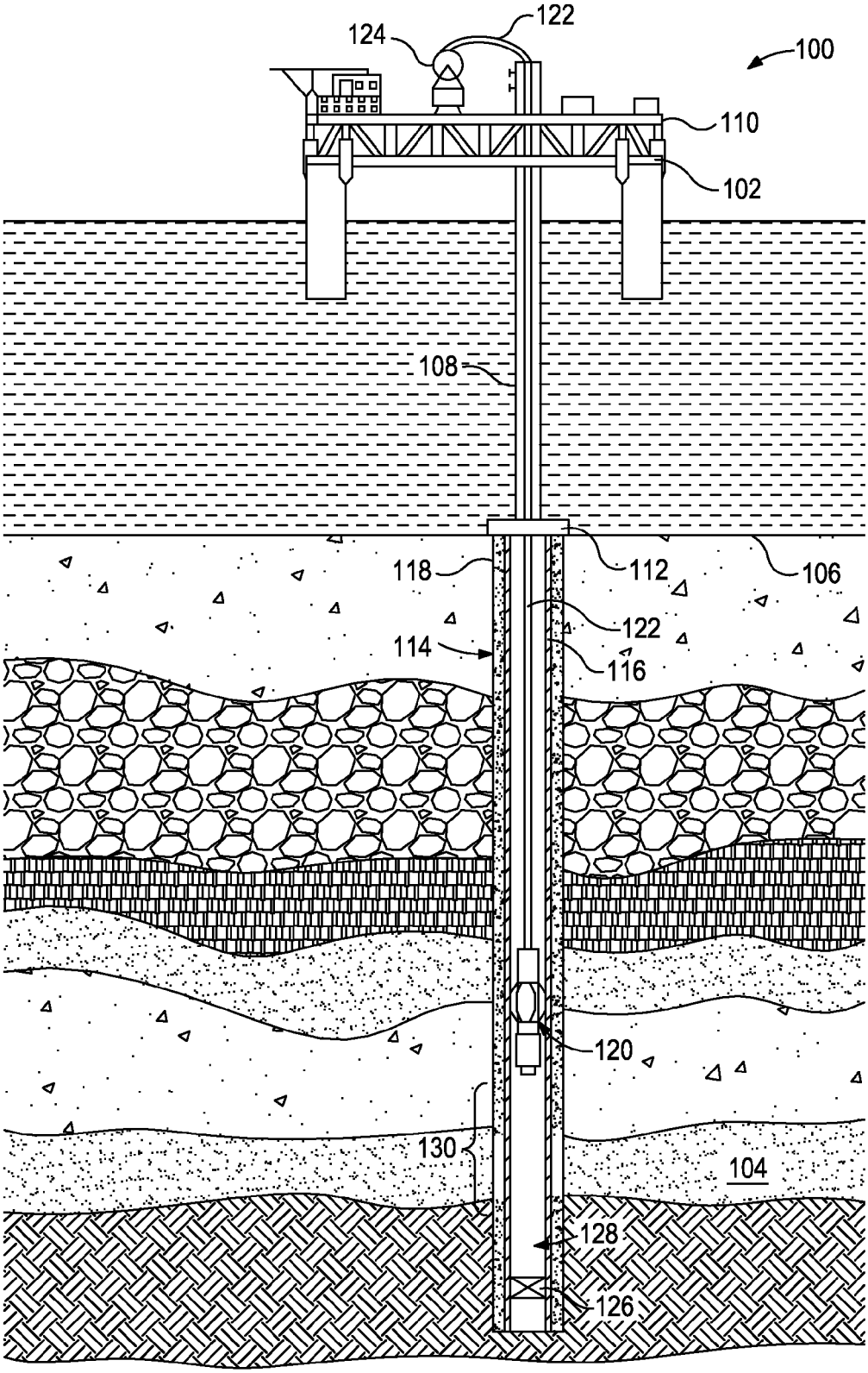
FIG. 1 is an offshore oil and gas rig that may employ one or more principles of the present disclosure, according to one or more embodiments.

Referring to FIG. 1, illustrated is an offshore oil and gas rig 100 that may employ one or more principles of the present disclosure, according to one or more embodiments. Even though FIG. 1 generally depicts an offshore oil and gas rig 100, those skilled in the art will readily recognize that the various embodiments disclosed and discussed herein are equally well suited for use in or on other types of service rigs, such as land-based rigs or rigs located at any other geographical site.

As illustrated, the rig 100 may encompass a semi-submersible platform 102 centered over one or more submerged oil and gas formations 104 located below the sea floor 106. A subsea conduit 108 or riser extends from the deck 110 of the platform 102 to a wellhead installation 112 arranged at or near the sea floor 106. As depicted, a wellbore 114 extends from the sea floor 106 and has been drilled through various earth strata, including various submerged oil and gas formations 104. A casing string 116 is at least partially cemented within the main wellbore 114 with cement 118. The term "casing" is used herein to designate a tubular string used to line the wellbore 114. The casing may actually be of the type known to those skilled in the art as "liner" and may be segmented or continuous.

During the viable life of the well, hydrocarbons may have been extracted from the submerged oil and gas formations 104 and produced to the rig 100 via the wellbore 114 and the riser 108 for processing. Once the available hydrocarbons in the formations 104 are depleted or it is otherwise economically impracticable to maintain the well, a well operator may decide to decommission the well. Decommissioning the well may entail preparing and plugging the wellbore 114 such that unwanted subterranean fluids are prevented from escaping into the surrounding environment. After the well is properly plugged, the well operator may abandon the wellbore 114. This well decommissioning undertaking is often referred to as a "plug and abandon" operation.

According to the present disclosure, the wellbore 114 may be prepared for plugging and abandonment using a casing cutting tool 120 that is introduced into the wellbore 114 from the rig 100. The casing cutting tool 120 may be run into the wellbore 114 on a conveyance 122, which may be fed into the wellbore 114 from a spool or reel 124 arranged on the deck 110 of the platform 102. In some embodiments, the conveyance 122 may be coiled tubing (also referred to as coil tubing) or the like. In other embodiments, the conveyance 122 may be any rigid or semi-rigid conduit capable of conveying the casing cutting tool 120 into the wellbore 114. In at least one embodiment, the conveyance 122 may be drill pipe or another type of rigid tubular and, in such embodiments, the reel 124 may be omitted or otherwise unneeded.

As part of the preparation process for plugging and abandoning the wellbore 114, a cement plug or bridge plug 126 may be set within the wellbore 114 below the casing cutting tool 120 to seal the lower portion of the wellbore 114. In some cases, the bridge plug 126 may be pre-placed in the wellbore 114 prior to running in the casing cutting tool 120. In other embodiments, the casing cutting tool 120 may help facilitate the placement and setting of the bridge plug 126. The borehole area above the bridge plug 126 and below the area of the wellbore 114 to be prepared may be referred to as a "rathole" 128, and may be suitable for the accumulation of debris and casing cuttings generated by the casing cutting tool 120.

As will be described in greater detail below, the casing cutting tool 120 may be configured to strategically excise portions of the wellbore 114, including corresponding portions of the casing string 116 and cement 118, over a predetermined section or length 130 of the wellbore 114. The excised portions of the wellbore 114 (e.g., pieces of the casing string 116 and cement 118) may fall into the rathole 128 therebelow, thus exposing the rock face of the surrounding formation 104 for the subsequent placement of a cement plug (not shown). Advantageously, by falling into the rathole 128, the excised portions of the casing string 116 and the cement 118 are also removed from the area of the wellbore 114 that is to be plugged, thereby not presenting an obstruction to the subsequent cementing operation.

The axial length 130 of the wellbore 114 to be treated or otherwise cut with the casing cutting tool 120 may be any length required to properly plug and seal the wellbore 114 with a cement plug. In some embodiments, for example, the axial length 130 of the wellbore 114 to be treated may range from about 30 feet to about 150 feet. Those skilled in the art, however, will readily recognize that the axial length 130 to be treated or cut may be less than 30 feet or more than 150 feet, without departing from the scope of the disclosure. In some cases, for example, a minimum or predetermined axial length 130 may be required or otherwise prescribed by local wellbore decommissioning laws and/or regulations.

Figure 2:
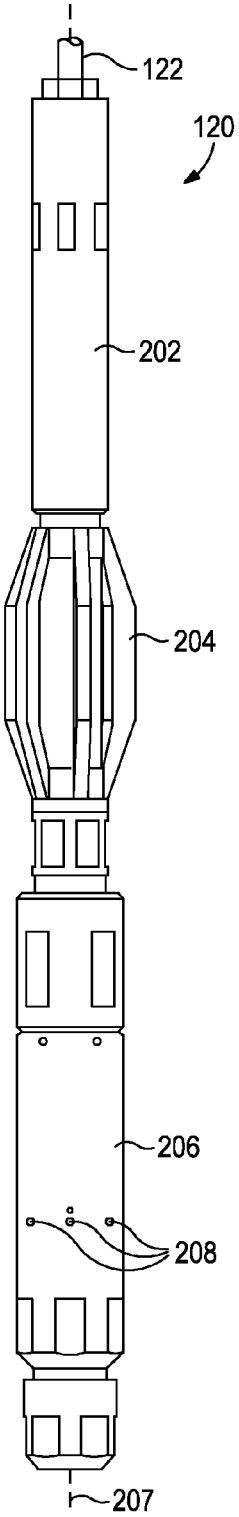
FIG. 2 illustrates an exemplary casing cutting tool, according to one or more embodiments.

Referring now to FIG. 2, with continued reference to FIG. 1, illustrated is an exemplary casing cutting tool 120, according to one or more embodiments. As illustrated, the casing cutting tool 120 may at least include a top mandrel 202, a centralizer 204, and a jetting tool 206, each being arranged along a longitudinal axis 207 of the casing cutting tool 120. While the casing cutting tool 120 is depicted in FIG. 2 as having a particular design and structural configuration, those skilled in the art will readily recognize that many variations to the design, configuration, and components of the casing cutting tool 120 may equally be used, without departing from the scope of the disclosure. For instance, the structural arrangement of the top mandrel 202, the centralizer 204, and the jetting tool 206 along the axial length of the casing cutting tool 120 may vary, depending on the application.

In the illustrated embodiment, the top mandrel 202 may be operatively coupled to the conveyance 122 by any means known to those skilled in the art. The centralizer 204 may interpose the top mandrel 202 and the jetting tool 206. The centralizer 204 may be configured to generally centralize the casing cutting tool 120 within the casing string 116 while the casing cutting tool 120 operates and is otherwise conveyed into the wellbore 114. The centralizer 204 may also prove advantageous in centralizing the casing cutting tool 120 within the wellbore 114 as the casing cutting tool 120 is rotated about the longitudinal axis 207. The centralizer 204 may further prove advantageous by generally maintaining the jetting tool 206 at a predetermined and known distance from the inner wall of the casing string 116 during operation.

The jetting tool 206 may have one or more jets or nozzles 208 (three shown) arranged thereon and at least partially exposed about the circumference of the jetting tool 206. In some embodiments, the nozzles 208 may be equidistantly spaced from each other about the circumference of the jetting tool 206. In other embodiments, however, one or more of the nozzles 208 may be randomly spaced from each other about the circumference of the jetting tool 206, without departing from the scope of the disclosure.

In some embodiments, as illustrated, the nozzles 208 may be arranged about the circumference of the jetting tool 206 in a single axial plane along the length of the jetting tool 206. In other embodiments, however, one or more of the nozzles 208 may be axially offset from one or more other nozzles 208 along the length of the jetting tool 206. In at least one embodiment, for example, the nozzles 208 may be arranged about the circumference of the jetting tool 206 in a generally helical arrangement such that each nozzle 208 is at least one of axially and radially offset from the other nozzles 208. Those skilled in the art will readily appreciate that different arrangements or configurations of the nozzles 208 in the jetting tool 206 may be employed, without departing from the scope of the disclosure.

Moreover, while only three nozzles 208 are depicted in FIG. 2, it will be appreciated that more or less than three nozzles 208 may be used in the jetting tool 206, without departing from the scope of the disclosure. The number of nozzles 208 required or desired may depend on the structural parameters of the wellbore 114 in which the casing cutting tool 120 is to be used. For example, the required number of nozzles 208 may vary depending on the thickness of the casing string 116, whether the casing string 116 comprises two or more concentrically-disposed casing strings, the thickness of the cement 118 surrounding the casing string(s) 116, and other wellbore 114 parameters known to those skilled in the art.

The nozzles 208 may be fluid jet nozzles or hydrajet nozzles configured to receive and direct a fluid at an elevated pressure and velocity towards the inner wall of the wellbore 114 (i.e., the casing string 116 and the cement 118). The fluid ejected from the nozzles 208 may be configured to cut into and through the casing string 116 and the surrounding cement 118 (FIG. 1) over the predetermined axial length 130 of the wellbore 114. The conveyance 122 may be configured to provide the casing cutting tool 120 and the nozzles 208 with the fluid and the nozzles 208 may be designed to operate in extreme downhole conditions, including operating in elevated temperatures, pressures, and within corrosive environments.

The fluid used in the jetting tool 206 may be any fluid known to those skilled in the art that is able to cut through materials commonly found in wellbores 114, such as steel and cement. In some embodiments, when cutting pure cement, for example, the fluid may be pure water, brine, or another aqueous mixture. In other embodiments, such as when cutting steel is required, the fluid may be an abrasive cutting solution formed by mixing water and abrasive particles. Suitable abrasive particles include, but are not limited to, sand (fine or coarse), bauxite, garnets, ash, semi-water soluble materials, such as borax or colemanite, combinations thereof, and the like. In at least one embodiment, the abrasive cutting solution may include one or more surfactants and/or an acid or a base.

Figure 3:
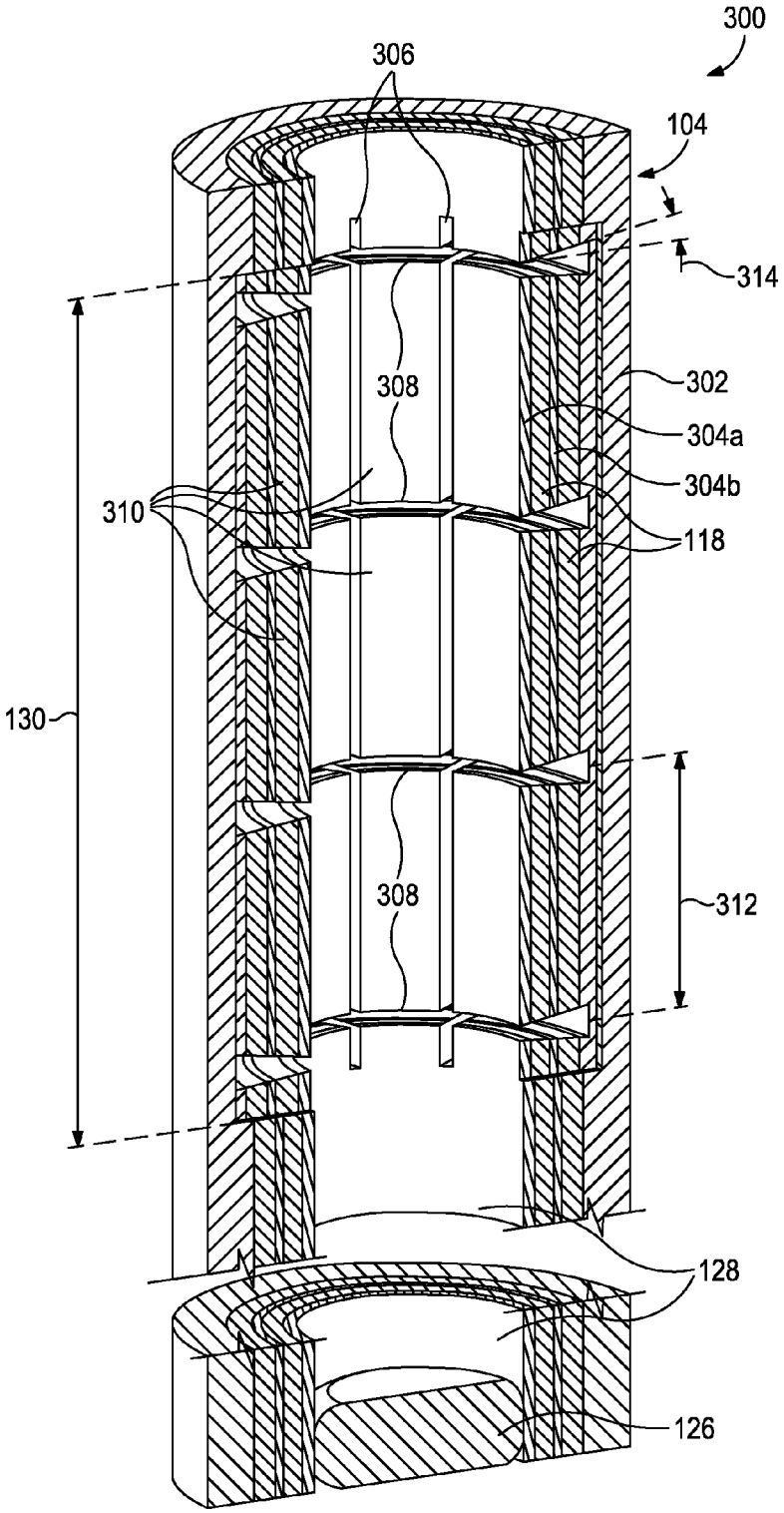
FIG. 3 illustrates a cross-sectional view of a portion of an exemplary wellbore that has been treated or cut using the exemplary casing cutting tool of FIG. 2, according to one or more embodiments.

Referring now to FIG. 3, with continued reference to FIGS. 1 and 2, illustrated is a cross-sectional view of a portion of an exemplary wellbore 300 that has been treated or cut using the exemplary casing cutting tool 120 of FIG. 2. The wellbore 300 may be similar in some respects to the wellbore 114 of FIG. 1 and therefore will be best understood with reference thereto, where like numerals will represent like elements or components. As illustrated, the wellbore 300 may be defined or otherwise drilled into formation rock 302 that forms part of the one or more subterranean formations 104.

The wellbore 300 may be lined with a first casing string 304*a* and a second casing string 304*b*, where the first casing string 304*a* is concentrically-arranged within the second casing string 304*b*. While two casing strings 304*a,b* are depicted in FIG. 3, those skilled in the art will readily appreciate that more than two casing strings 304*a,b* may line the wellbore 300 or, alternatively, only one casing string may line the wellbore 300, such as the casing string 116 of FIG. 1, without departing from the scope of the disclosure.

In the illustrated embodiment, cement 118 may be disposed between the two casing strings 304*a,b* and also between the second casing string 304*b* and the formation rock 302. A bridge plug 126 may also be installed or otherwise set within the wellbore 300 a distance below the area of the wellbore 300 that is to be treated with the casing cutting tool 120. The rathole 128 may be defined in the wellbore 300 above the bridge plug 126 and generally below the area of the wellbore 300 that is to be treated.

As illustrated, the casing cutting tool 120 has made a plurality of longitudinal cuts 306 and a plurality of transverse cuts 308 in the wellbore 300 encompassing the predetermined axial length 130 of the wellbore 300 that is to be treated. The longitudinal and transverse cuts 306, 308 generate corresponding gaps in the wellbore 300 that define a plurality of removable pieces, portions, slats, chunks, or wedges 310 of the wellbore 300. To make the longitudinal cuts 306, the casing cutting tool 120 may be slowly moved or "stroked" up or down axially within the wellbore 300 over the axial length 130. To accomplish this, the conveyance 122, as operated from the platform 110 (FIG. 1), may manipulate and regulate the axial position and speed of the casing cutting tool 120 during operation. As the casing cutting tool 120 moves within the wellbore 300, the nozzles 208 (FIG. 2) continuously eject fluid that cuts through the first and second casing strings 304*a,b* and the cement 118. In some embodiments, the casing cutting tool 120 may be stroked within the wellbore 300 multiple times in order to penetrate the first and second casing strings 304*a,b* and the cement 118 until reaching or otherwise exposing the formation rock 302.

As will be appreciated, the number of longitudinal cuts 306 may depend directly on the number of nozzles 208 employed in the casing cutting tool 120. Alternatively, any number of longitudinal cuts 306 may be made using any number of nozzles 208. For example, one or more initial longitudinal cuts 306 may be made with the casing cutting tool 120 along the axial length 130 and, after cutting the initial longitudinal cuts 306, the casing cutting tool 120 may be rotated about its longitudinal axis 207 such that one or more additional longitudinal cuts 306 may be made. As a result, the initial longitudinal cuts 306 and the additional longitudinal cuts 306 may be circumferentially-offset from each other.

In some embodiments, the transverse cuts 308 are made following the formation of the longitudinal cuts 306. To make the transverse cuts 308, the casing cutting tool 120 may be rotated about its longitudinal axis 207 at predetermined locations or depths along the axial length 130. The conveyance 122, as manipulated or regulated from the platform 110, may serve to rotate the casing cutting tool 120 at a desired speed and/or over a predetermined time limit in order to properly form the transverse cuts 308. As the casing cutting tool 120 is rotated, the nozzles 208 (FIG. 2) continuously eject the fluid to cut through the first and second casing strings 304*a,b* and the cement 118 in an annular pattern. In some embodiments, the casing cutting tool 120 may be rotated about its longitudinal axis 207 multiple times in order to properly penetrate the first and second casing strings 304*a,b* and the cement 118 until reaching or otherwise exposing the formation rock 302.

In some embodiments, the transverse cuts 308 may be made starting at or near the bottom of the axial length 130. Once the first transverse cut 308 is made at a first location, the conveyance 122 may move the casing cutting tool 120 axially in the uphole direction (e.g., towards the top of FIG. 3) a short distance 312 to a second location. The distance 312 between axially adjacent transverse cuts 308 (i.e., between the first and second locations) may vary, depending on the application. In some embodiments, for example, the distance 312 between axially adjacent transverse cuts 308 may be about six inches. In other embodiments, however, the distance 312 between axially adjacent transverse cuts 308 may be about one foot, about two feet, about five feet, any distance therebetween, or greater than five feet. After forming the transverse cut 308 at the second location, the casing cutting tool 120 may be again moved in the uphole direction to a third location. This process may be repeated until transverse cuts 308 are formed along substantially all of the predetermined axial length 130 of the wellbore 114.

The combined longitudinal and transverse cuts 306, 308 serve to carve out and otherwise define the wedges 310 in the wellbore 300. The fluid pressure of the nozzles 208 (FIG. 2) may pressurize the area behind each wedge 310, thereby causing the wedges 310 (i.e., the first and second casing strings 304*a,b* and cement 118) to dislodge from the formation rock 302 and drop into the rathole 128 therebelow. In other words, as the jet pressure impinges upon, impacts and otherwise erodes the backside of each wedge 310, the wedges 310 may be dislodged and extricated from the formation rock 302, thereby allowing the loosed wedges 310 to fall into the rathole 128.

As will be appreciated, however, since the wellbore 300 is round, the cuts 306, 308 made into the wellbore 300 will radially extend into the wellbore 300 such that the outer radial dimension of each cut 306, 308 will be greater than its corresponding inner radial dimension. This means, theoretically, that if the cuts 306, 308 were narrow cuts, such as being cut by a thin knife or the like, then the wedges 310 would be prevented from being excised or extricated because of their resulting larger outer radial dimensions.

According to the present disclosure, however, the jet generated by each nozzle 208 may naturally "flare out" or otherwise create a correspondingly wider cut in the wellbore 300 as the jet extends deeper into the wellbore 300 in the radial direction. In some embodiments, the jet may be configured to flare out even more by using high viscosity fluids. As a result, each resulting cut 306, 308 may be wider at its outer radial dimension than at its corresponding inner radial dimension. In some embodiments, for example, the nozzles 208 may generate a jet that creates a cut that exhibits an angle 314. The angle 314 of the cut may vary depending on the type of nozzle 208, the fluid type, the pressure of the fluid, the velocity of the fluid, and other hydro-jetting parameters known to those skilled in the art. In at least one embodiment, the angle 314 of the cut generated by the nozzles 208 may range between about 10° and about 20°, between about 12° and about 18°, or between about 15° and about 16°.

As the cuts 306, 308 extend deeper and deeper into the walls of the wellbore 300 (i.e., penetrating the first and second casing strings 304*a,b* and cement 118), sand, cement, and/or other debris may be loosened within the forming gaps and cavities. The violent swirling of the jet produced by each nozzle 208, in conjunction with the sand, cement, and/or other debris, may proceed to erode the cavity walls, thereby generating a larger opening at the outer radial dimension of each cut 306, 308 than at its corresponding inner radial dimension. As a result, the wedges 310 may be extricated from the formation rock 302 without having their corresponding outer radial dimension bind on its corresponding inner radial dimension. Consequently, during the cutting of the transverse cuts 308, the bond caused by the cement 118 between the second casing string 304*b* and the inner diameter of the formation rock 302 may be released such that the wedges 310 are able to be dislodged from the formation rock 302 and fall into the rathole 128 therebelow.

Figure 4A:
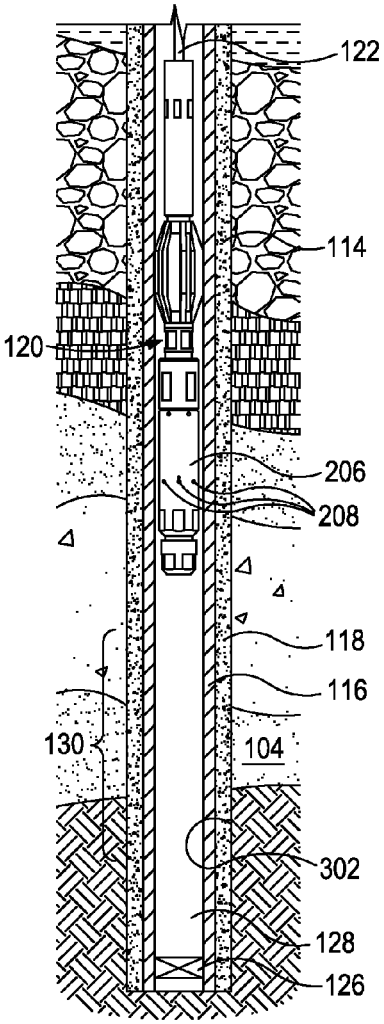
FIGS. 4A-4C illustrate progressing views of a wellbore over the span of an exemplary casing cutting operation, according to one or more embodiments.
Figure 4B:
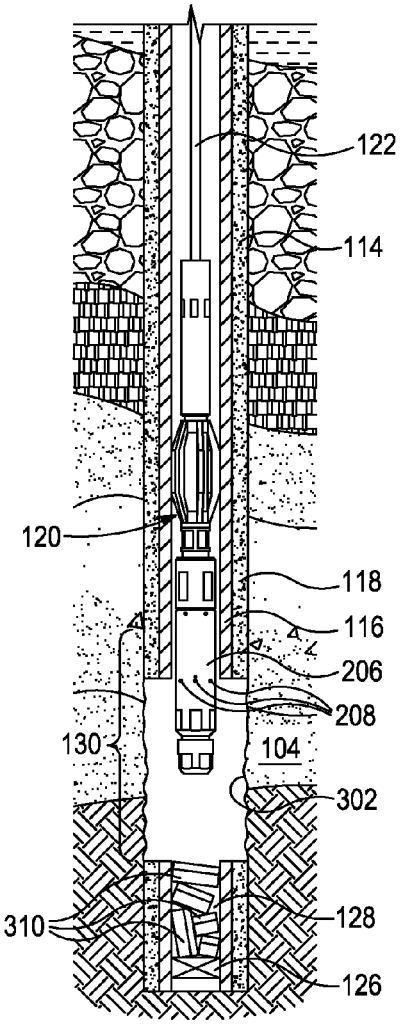
Figure 4C:
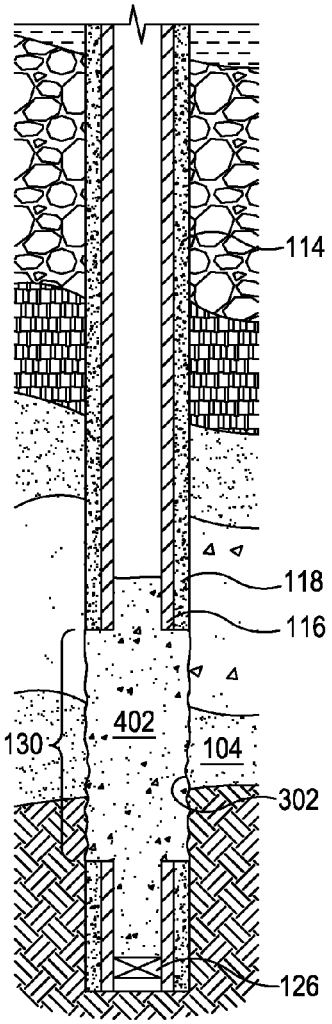

Referring now to FIGS. 4A-4C, with continued reference to the preceding figures (especially FIG. 1), illustrated are progressing views of the wellbore 114 of FIG. 1 over the span of an exemplary casing cutting operation, according to one or more embodiments. More particularly, FIG. 4A illustrates the casing cutting tool 120 as it is extended into the wellbore 114 to the target location where the wellbore 114 is to be prepared for a plugging and abandonment operation. As described above, the casing cutting tool 120 may be configured to excise or remove a predetermined axial length 130 of the wellbore 114, including the removal of the casing string 116 and surrounding cement 118 to thereby expose the underlying formation rock 302.

Prior to introducing the casing cutting tool 120 into the wellbore 114, several parameters of the operation may be determined or otherwise measured. For example, a wellbore operator may first determine the required or desired axial length 130 of the wellbore 114 to be removed. Knowing the required axial length 130 may provide the user with information as to the stroke length required by the conveyance 122 and also how many transverse cuts 308 (FIG. 3) will be needed. Other parameters of the operation that may be determined include, but are not limited to, the inner diameter of the casing string 116 ("$ID_C$"), the inner diameter of the open hole ("$ID_O$") (e.g., the approximate inner diameter of the formation rock 302), and the outer diameter of the jetting tool 206 ("$OD_{JT}$"). Using these measurements and determinations, the jetting distance to the casing string 116 from the jetting tool 206 "$D_i$" and the jetting distance to the formation rock 302 from the jetting tool 206 "$D_d$" may be determined using the following equations:

$$D_i=ID_C-OD_{JT} \quad \text{Equation (1)}$$

$$D_d=ID_O-OD_{JT} \quad \text{Equation (2)}$$

Knowing the jetting distance to the casing string 116 "$D_i$" and the jetting distance to the formation rock 302 "$D_d$" allows an operator to determine the size of the frontside of each cut "FC" and the size of the backside of each cut "BC" using the following equations:

$$FC=D_i*\tan(16°)+NS=0.286D_i+NS \quad \text{Equation (4)}$$

$$BC=D_d*\tan(16°)+NS=0.286D_d+NS \quad \text{Equation (5)}$$

where "NS" is the selected size of each nozzle 208, and 16° is the assumed angle 314 (FIG. 3) of the cut made by the selected NS. The width of the frontside of the resulting cut "$C_F$" and the width of the backside of the resulting cut "$C_B$" may then be determined using the following equations:

$$C_F=\pi*ID_C/N+2*FC \quad \text{Equation (6)}$$

$$C_B=\pi*ID_O/N-BC \quad \text{Equation (7)}$$

where "N" is the number of nozzles 208 used in the jetting tool 206. The number N of nozzles 208 in the jetting tool 206 may then be manipulated until the width of the frontside of the resulting cut $C_F$ becomes greater than the width of the backside of the resulting cut $C_B$. With the appropriate number N of nozzles 208 known or otherwise determined, an operator can run the casing cutting tool 120 into the wellbore 114 with an appropriately configured jetting tool 206.

Still referring to FIG. 4A, the bridge plug 126 may be set within the wellbore 114 to generally seal the lower portions of the wellbore 114. As discussed above, this may be done prior to running in the casing cutting tool 120 or, alternatively, the casing cutting tool 120 may help facilitate the placement and setting of the bridge plug 126. In some embodiments, the bridge plug 126 may be set 100-200 feet below the area of the wellbore 114 that is to be cut or otherwise prepared, thereby forming the rathole 128 therebetween. As will be appreciated, however, the bridge plug 126 may be set at any distance desired below the area of the wellbore 114 that is to be cut. The resulting rathole 128 may be configured to be large enough to receive and contain all the debris and wedges 310 (FIG. 3) that will fall therein as a result of the operation of the casing cutting tool 120.

In FIG. 4B, the casing cutting tool 120 has commenced cutting the wellbore 114 such that multiple wedges 310 (e.g., including pieces of both the casing string 116 and the cement 118) and other debris have fallen into the rathole 128 therebelow. Once the wedges 310 are removed, the face of the formation rock 302 becomes exposed. To cut the wedges 310, as described above, the casing cutting tool 120 may first be slowly stroked up and/or down the predetermined axial length 130 of the wellbore 114 in order to define the longitudinal cuts 306 (FIG. 3). Depending on how many layers of casing string 116 the wellbore 114 has, and the thickness of the cement 118, the casing cutting tool 120 may have to be stroked multiple times in order to reach the formation rock 302. In some embodiments, for example, the casing cutting tool 120 may be stroked three times the number of casing strings 116 present in the wellbore 114.

Once the longitudinal cuts 306 (FIG. 3) are completed, the casing cutting tool 120 may be used to form the transverse cuts 308 (FIG. 3). Again, depending on how many layers of casing string 116 the wellbore 114 has and the thickness of the cement 118, the casing cutting tool 120 may have to be rotated about its longitudinal axis 207 (FIG. 2) multiple times in order to reach the formation rock 302. In some embodiments, the casing cutting tool 120 may be rotated three times the number of casing strings 116 present in the wellbore 114. The hydraulic pressure from the jets generated by the nozzles 208 may serve to dislodge the corresponding cut wedges 310 from the formation rock 302 such that they fall into the rathole 310. Once a transverse cut 308 is completed, the casing cutting tool 120 may be moved uphole a short distance 312 (FIG. 3), and another transverse cut 308 may be cut at that point and additional wedges 310 may thereby be excised and fall into the rathole 128. The transverse cuts 308 may be made along the entire axial length 130 at, for example, increments of the distance 312 (FIG. 3).

Referring to FIG. 4C, once the casing cutting tool 120 has made all the planned longitudinal and transverse cuts 306, 308, and the wedges 310 have each fallen into the rathole 128, the exposed face of the formation rock 302 may be left across all or a portion of the predetermined axial length 130. In some embodiments, a camera (not shown) or the like may be run into the wellbore 114 to inspect the face of the formation rock 302 to determine if the operation was successful. At this point, a solid cement plug 402 may be placed in the wellbore 114 in order to properly seal the wellbore 114 across the predetermined axial length 130. The bridge plug 126 prevents the cement plug 402 from extending downhole past that point. In some embodiments, the wedges 310 may be removed from the wellbore 114 prior to placing the cement plug 402. In other embodiments, however, the wedges 310 may be cemented into place within the wellbore 114 and otherwise form part of the cement plug 402.

In some embodiments, the cement plug 402 may be placed in the wellbore 114 with any wellbore cementing tool (not shown) known to those skilled in the art and conveyed therein using coiled tubing or the like. In other embodiments, however, the casing cutting tool 120 may be configured to place the cement plug 402 following its cutting operations. In such embodiments, the cement used to make the cement plug 402 may be conveyed via the conveyance 122 to the casing cutting tool 120 and the jetting tool 206. The nozzles 208 may be configured to eject the cement from the jetting tool 206 across the predetermined axial length 130 of the wellbore 114, thereby sealing the exposed portions of the formation rock 302 and facilitating the setting of the cement plug 402.

As will be recognized by those skilled in the art, using the jetting tool 206 to place the cement plug 402 may prove advantageous. For instance, since cement is also an abrasive fluid, during the last few transverse cuts 308, cement may be pumped through the jetting tool 206 and used to cut the casing string 116 and the cement 118. After the last wedges 310 drop into the rathole 128, the jetting tool 206, while still pumping cement through its nozzles 128, may be lowered within the wellbore 114 in order to wash the exposed formation rock 302 with cement while simultaneously circulating the initial jetting fluid out of the jetting tool 206. In some cases, this cleanout procedure may result in a more robust cement plug 410.

As will be appreciated, by exposing the face of the formation rock 302, the cement from the cement plug 402 is able to directly contact the formation rock 302. As a result, the cement plug 402 will better seal the wellbore 114 such that no unwanted fluids may leak or otherwise effuse therefrom and traverse the wellbore 114 to the surrounding environment at the surface.

The Test Fixture

To verify and otherwise test the viability of the teachings of the present disclosure, the inventors designed and manufactured a test fixture. At least one of the purposes of designing and manufacturing the test fixture was to provide a viable solution for decommissioning offshore wells in the North Sea, but the test fixture could be used to test decommissioning operations of well located in any geographical region. As discussed above, some regulations for decommissioning involve placement of thick cement plugs across a predetermined location of a wellbore, requiring that a minimum of 50 meters of cement plug the region with direct contact to the formation wall. This means that corresponding casing sections must be completely removed, thereby exposing a portion of the rock formation, so that a solid cement plug can be formed in the newly exposed area. The effectiveness of the teachings discussed above was tested using a test fixture and the results of the tests were used to formulate one or more final chosen approaches for decommissioning wells.

Figure 5A:
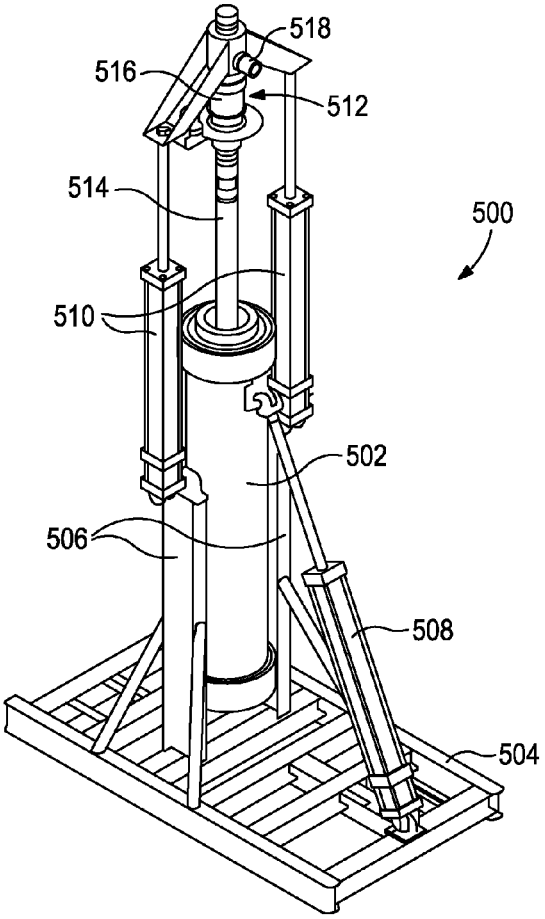
FIGS. 5A and 5B, illustrate isometric and side views, respectively, of an exemplary test fixture, according to one or more embodiments.
Figure 5B:
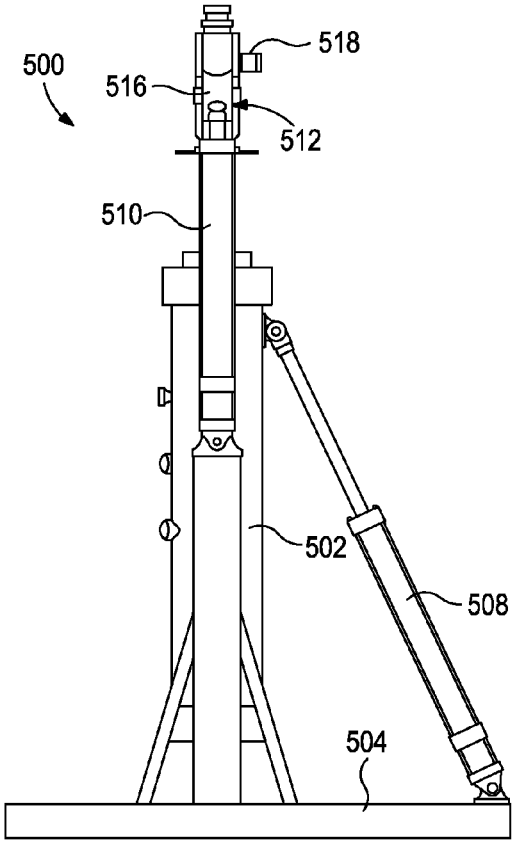

Referring now to FIGS. 5A and 5B, illustrated are isometric and side views, respectively, of an exemplary test fixture 500, according to one or more embodiments. While a particular test fixture 500 having specific components and dimensions is illustrated in FIGS. 5A and 5B, those skilled in the art will readily appreciate that various alterations or modifications to the test fixture 500 may be had, without departing from the scope of the disclosure, and equally obtain the same or similar confirmatory results. Consequently, in no way should the following description of the exemplary test fixture 500 be read to limit, or to define, the scope of the disclosure.

The text fixture 500 may be configured to create and otherwise provide a realistic downhole environment such that the teachings of the present disclosure may be tested for efficiency and viability. In particular, the test fixture 500 may be configured to withstand elevated hydrostatic pressures commonly found within wellbores. The test fixture 500 may be configured to withstand pressures greater than at least 700-1000 psi since at these pressures severe cavitation does not tend to occur. Those skilled in the art will readily recognize that fluid cavitation may enhance or otherwise adulterate jet cutting operations and, therefore, testing should not be done in atmospheric conditions. While impressive results can often result when testing is undertaken at atmospheric conditions, such results are likely inaccurate.

As illustrated, the test fixture 500 may include a chamber body 502 generally supported on a base 504 with one or more legs 506 (two shown). The chamber body 502 may be used to replicate common downhole conditions such that a variety of tests of the teachings of the present disclosure may be undertaken. Moreover, the chamber body 502 may be configured to house a sample wellbore section to be cut or otherwise treated, including a sample casing string and corresponding cement. The chamber body 502 may also be configured to receive and otherwise house a casing cutting tool, such as the casing cutting tool 120 described above.

While the chamber body 502 is shown as being supported generally using the one or more legs 506 on the base 504, those skilled in the art will readily recognize that other means may be employed to support the chamber body 502, without departing from the scope of the disclosure. For instance, an actuation device 508 may also serve to partially support the chamber body 502 on the base 504. The actuation device 508 may also serve to alter the angular disposition of the chamber body 502 in order to mimic or otherwise replicate deviated wellbore conditions. The actuation device 508 may be any mechanical, electromechanical, hydromechanical, hydraulic, or pneumatic device configured to produce mechanical motion and thereby move the chamber body 502. In some embodiments, for example, the actuation device 508 may be a motor or the like. In other embodiments, however, the actuation device 508 may be an actuator or a piston solenoid assembly.

The chamber body 502 was designed to provide at least 3000 psi back pressure at a designed flow rate of 22 barrels per minute (BPM). This was done by placing one or more 0.5 inch chokes in each return line (not shown) extending from the chamber body 502. The back pressure must be designed as such that the tests reflect the actual depth where the cut is to be made. This is set by multiplying the true depth of the location (in feet) by 0.47 (which is the average fluid column hydrostatic pressure/ft). Hence, for a well that is 10,000 ft deep, the back pressure for the chamber body 502 would be set at 4700 psi.

In at least one embodiment, the chamber body 502 exhibits an outer diameter of about 20 inches, a wall thickness of about 2 inches (thereby rendering an inner diameter of about 16 inches) in order to provide the ability to safely handle pressures reaching and surpassing 10,000 psig. The chamber body 502 may be designed such that it is long enough to contain the sample wellbore section (including a sample casing string and cement configuration) that is to be hydrajet cut according to the teachings of the present disclosure. In some embodiments, for instance, the chamber body 502 may be about 8 feet long, thereby providing enough axial length for a corresponding rathole used to receive cut slats or wedges of the sample wellbore section. The length of the chamber body 502 may also be long enough to house various tools and sensing equipment used for testing and diagnostic operations.

The test fixture 500 may also include one or more stroking devices 510 (two shown), a swivel head 512 operatively coupled to the one or more stroking devices 510, and a top mandrel 514 extending from the swivel head 512 and into the chamber body 502. While not shown in FIGS. 5A-5B, a casing cutting tool (such as the casing cutting tool 120 of FIG. 2) may be operatively coupled to the distal end of the top mandrel 514 and otherwise movably arranged within the chamber body 502. The stroking devices 510 may be configured to raise and lower the casing cutting tool within the chamber body 502 at a controlled cutting speed, thereby mimicking the stroke of the conveyance 120 of FIGS. 1 and 4A-4B and thereby also providing the longitudinal cut 306 (FIG. 3) in the sample wellbore section disposed within the chamber body 502. Similar to the actuation device 508, the stroking devices 510 may be any mechanical, electromechanical, hydromechanical, hydraulic, or pneumatic device configured to produce mechanical motion. Moreover, while two stroking devices 510 are shown in FIG. 5A, it will be appreciated that more or less than two stroking devices 510 may be employed, without departing from the scope of the disclosure.

The swivel head 512 may be configured to rotate the top mandrel 514 about its central axis, thereby mimicking the rotation of the conveyance 120 of FIGS. 1 and 4A-4B and thereby also rotating the casing cutting tool arranged within the chamber body 502. The swivel head 512 may be designed to allow rotary motion under high pressure. In some embodiments, the swivel head 512 may include a motor 516 (i.e., electric, electro-mechanical, hydraulic, pneumatic, etc.) configured to rotate the top mandrel 514. In at least one embodiment, the motor 516 may be remotely controlled in order to rotate the top mandrel 514 on command.

The swivel head 512 may include one or more inflow ports 518 configured for the receipt of the fluid (e.g., an abrasive cutting solution) used by the casing cutting tool. Since the flow rate of the fluid to the test fixture 500 may be high, it may prove advantageous to include two inflow ports 512 in order to reduce erosion effects. As mentioned above, three 0.5 inch chokes were used during testing. Combining the high flow rates into the chamber body 502 with the hydrajetting operation of the casing cutting tool could run the risk that chunks of cut material flow back thru the choked flow back line(s). As can be appreciated, if debris or chunks become lodged in the choke, water-hammer effects may cause serious damage on the pressurized equipment. Accordingly, in at least one embodiment, the chamber body 502 may further include at least three return lines (not shown), each choked separately, so that if one choke is plugged the return flow may be able to proceed through the other two return lines.

To design for the jetting tool used on the casing cutting tool during testing, the flare of the jet generated by each nozzle as it cuts the steel casing was assumed to be about 10° (inclusive angle) while the flare of the jet as it cuts through the cement was assumed to be about 20°. Using Equations (1)-(7) above, it was determined that the resulting slats, cement pieces, and/or wedges could move inward through the gaps or openings created in the smaller casing if the number of nozzles were seven or greater. Based on this, the jetting tool was designed to have eight nozzles, thus creating eight slats in the steel casing at once. In at least one embodiment, the HYDRA-JET™ hydrajetting tool available through Boots and Coots, a Halliburton Service, of Houston, Tex., USA may be used as the jetting tool.

In exemplary operation of the test fixture 500, the casing cutting tool is able to axially translate within the chamber body 502 as moved by the positioning devices 510 coupled through the swivel head 512 and top mandrel 514. Such movement may allow the casing cutting tool to generate the longitudinal cuts 306 (FIG. 3) in the sample wellbore section. Following the generation of the longitudinal cuts 306 (FIG. 3), the swivel head 512 may be used to rotate the casing cutting tool, thereby generating multiple transverse cuts 308 (FIG. 3) axially offset from each other along the length of the sample wellbore section. In some test scenarios, the actuation device 508 may be used to alter the angular configuration of the chamber body 502, and thereby provide test results mimicking operations in a deviated wellbore.

Once the sample wellbore section has been cut both longitudinally and radially under testing conditions, the chamber body 502 may be opened and otherwise its contents may be removed therefrom to confirm whether the casing cutting tool operated properly. If the chunks or wedges of the sample wellbore section are properly dislodged and have fallen into the rathole, then the test may be considered a success under the specified testing parameters. If one or more slats, chunks, or wedges fail to fall into the rathole, parameters of the operation may be altered in order to render a successful test. Parameters of operation that may be altered include, but are not limited to, increasing the flow rate of the corrosive cutting solution, changing the size, number or configuration of the nozzles of the jetting tool, altering the stroking speed of the mandrel, adjusting the number of times the mandrel strokes or rotates the casing cutting tool, and combinations thereof.

Use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method of removing a section of a wellbore, comprising:

conveying a casing cutting tool into the wellbore on a conveyance, the wellbore being lined with at least one casing string and cement, and the casing cutting tool including a jetting tool having one or more nozzles arranged thereon;

stroking the casing cutting tool with the conveyance over a predetermined axial length of the wellbore while ejecting fluid from the one or more nozzles and thereby forming two or more longitudinal cuts through the at least one casing string and the cement;

rotating the casing cutting tool about a longitudinal axis of the casing cutting tool at two or more axially offset locations along the predetermined axial length while ejecting fluid from the one or more nozzles and thereby forming a corresponding two or more axially offset transverse cuts in the at least one casing string and the cement, whereby the two or more longitudinal cuts and the corresponding two or more axially offset transverse cuts form one or more wedges in the wellbore, each wedge comprising a portion of the at least one casing string and the cement;

breaking one or more bonds between the cement and the underlying formation rock, including any such one or more bonds located in any non-perimeter area of each of the one or more wedges, with jet pressure generated by the one or more nozzles; and dislodging the one or more wedges from the underlying formation rock exclusively with the jet pressure such that the one or more wedges fall away from and expose the formation rock along at least a portion of the predetermined axial length.

2. The method of claim 1, wherein the fluid is ejected from the one or more nozzles in corresponding streams of fluid comprising an angle such that an outer circumferential width of the one or more wedges is less than an inner circumferential width of the one or more wedges, thereby enabling a first wedge to be extricated from the formation rock prior to adjacent wedges being dislodged.

3. The method of claim 2, wherein the angle of the streams of fluid is between about 10° and about 20°.

4. The method of claim 3, wherein each of the longitudinal cuts has a width that increases in proportion to a distance outward from the inside radius of an innermost surface of the at least one casing string and cement.

5. The method of claim 1, further comprising at least one of stroking and rotating the casing cutting tool while ejecting one or more streams of cement from the one of more nozzles, thereby washing the exposed formation rock with the cement.

6. The method of claim 1, wherein forming the two or more longitudinal cuts comprises stroking the casing cutting tool with the conveyance multiple times over the predetermined axial length.

7. The method of claim 1, wherein rotating the casing cutting tool about the longitudinal axis comprises rotating the casing cutting tool multiple times about its longitudinal axis in at least one of the two or more axially offset locations in order to penetrate the at least one casing string and the cement.

8. The method of claim 1, wherein the two or more axially offset locations comprise a first location and a second location axially offset from the first location in an uphole direction, the method further comprising:

forming a first transverse cut at the first location in the at least one casing string and the cement with the fluid ejected from the one or more nozzles;

moving the casing cutting tool to the second location; and forming a second transverse cut at the second location in the at least one casing string and the cement with the fluid ejected from the one or more nozzles.

9. The method of claim 1, wherein dislodging the one or more wedges comprises eroding an area behind each wedge.

10. The method of claim 1, further comprising receiving the one or more wedges in a rathole defined in the wellbore below the predetermined axial length of the wellbore and above a bridge plug arranged within the wellbore.

11. The method of claim 1, further comprising placing a cement plug in the wellbore across at least a portion of the predetermined axial length, wherein the cement plug contacts exposed portions of the formation rock.

12. The method of claim 11, wherein placing the cement plug in the wellbore comprises placing the cement plug in wellbore using the casing cutting tool.

13. The method of claim 1, further comprising cutting at least one of the two or more longitudinal cuts and the two or more transverse cuts with cement.

14. A system, comprising:

a wellbore formed through one or more subterranean formations and lined with at least one casing string and cement;

a casing cutting tool conveyable into the wellbore on a conveyance and including a jetting tool having one or more nozzles arranged thereon, the jetting tool being configured to form a plurality of longitudinal cuts and a plurality of transverse cuts in the at least one casing string and the cement across a predetermined axial length of the wellbore with fluid ejected from the one or more nozzles, wherein one or more wedges comprising a portion of the at least one casing string and the cement are defined in the wellbore as a result of the plurality of longitudinal and transverse cuts, and wherein jet pressure generated by the one or more nozzles breaks one or more bonds between the cement and the underlying formation rock, including any such one or more bonds located in any non-perimeter area of each of the one or more wedges; and a rathole defined in the wellbore below the predetermined axial length of the wellbore and above a bridge plug arranged within the wellbore, the rathole receiving the one or more wedges once dislodged from the underlying formation rock exclusively with the jet pressure such that the one or more wedges fall away from and expose the formation rock along at least a portion of the predetermined axial length.

15. The system of claim 14, wherein the one or more nozzles comprise a plurality of nozzles arranged about a circumference of the jetting tool in a single axial plane.

16. The system of claim 14, further comprising a cement plug placed in the wellbore across at least a portion of the predetermined axial length, the cement plug being configured to contact exposed portions of the formation rock.

17. The system of claim 14, wherein the fluid is an abrasive cutting solution.

18. The system of claim 17, wherein the abrasive cutting solution is cement.

* * * * *